US007272937B2

(12) United States Patent
Mita et al.

(10) Patent No.: US 7,272,937 B2
(45) Date of Patent: Sep. 25, 2007

(54) COOLING DEVICE

(75) Inventors: Hideo Mita, Okazaki (JP); Tetsuya Gotou, Nagoya (JP); Motohiro Igarasi, Nagoya (JP); Takayuki Furusawa, Nagoya (JP); Toshiyuki Amano, Tokyo (JP); Yoshihiro Jizo, Tokyo (JP)

(73) Assignees: Aisin Seiki Kabushiki Kaisha, Kariya-shi (JP); Central Japan Railway Company, Nagoya-shi (JP); Mitsubishi Denki Kabushiki Kaisha, Tokyo (JP)

( * ) Notice: Subject to any disclaimer, the term of this patent is extended or adjusted under 35 U.S.C. 154(b) by 421 days.

(21) Appl. No.: 10/486,353

(22) PCT Filed: Aug. 29, 2002

(86) PCT No.: PCT/JP02/08734

§ 371 (c)(1),
(2), (4) Date: Oct. 4, 2004

(87) PCT Pub. No.: WO03/019088

PCT Pub. Date: Mar. 6, 2003

(65) Prior Publication Data

US 2006/0242968 A1 Nov. 2, 2006

(30) Foreign Application Priority Data

Aug. 31, 2001 (JP) ..... 2001-264211

(51) Int. Cl.
*F25B 9/00* (2006.01)
*F17C 5/02* (2006.01)

(52) U.S. Cl. ..... 62/6; 62/47.1

(58) Field of Classification Search ..... 62/6, 62/47.1, 48.2, 51.1
See application file for complete search history.

(56) References Cited

U.S. PATENT DOCUMENTS 5,584,184 A * 12/1996 Inaguchi et al. ..... 62/6
5,613,367 A * 3/1997 Chen ..... 62/47.1

(Continued)

FOREIGN PATENT DOCUMENTS

JP 11-63699 3/1999

(Continued)

*Primary Examiner*—William C Doerrier
(74) *Attorney, Agent, or Firm*—Oblon, Spivak, McClelland, Maier & Neustadt, P.C.

(57) ABSTRACT

A cooling apparatus comprises a pulse tube refrigerator (A) having a pressure source (1), a cold reservoir (6), a condenser (7), a pulse tube (9), a radiator (10), and a phase adjuster (12); and a low-temperature container having a liquid reservoir (21) fixed to a vacuum tank (31) through heat-insulating support members (36) and (37). The condenser (7) is fixed to a cold end (6*b*) of the cold reservoir (6), and is disposed in a gas phase portion (21*a*) of the liquid reservoir (21). A hot end of the pulse tube (9) is fixed to the vacuum tank (31) and is disposed in such a manner that a cold end (9*b*) of the pulse tube (9) is located lower than the hot end and is located in a liquid phase portion (21*b*) of the liquid reservoir (21). The cold end (9*b*) of the pulse tube (9) is disposed outside the liquid reservoir (21) but within the vacuum tank (31), and the cold end (9*b*) of the pulse tube (9) and the condenser (7) communicate with each other through piping (8).

8 Claims, 8 Drawing Sheets

U.S. PATENT DOCUMENTS 5,918,470 A * 7/1999 Xu et al. ..... 62/51.1
5,966,944 A * 10/1999 Inoue et al. ..... 62/51.1
6,029,458 A * 2/2000 Eckels ..... 62/47.1
6,196,008 B1 3/2001 Kawano et al.
6,430,938 B1 * 8/2002 Royal et al. ..... 62/6

FOREIGN PATENT DOCUMENTS

JP 11-508991 8/1999

* cited by examiner

PRIOR ART

COOLING DEVICE

TECHNICAL FIELD

The present invention relates to a cooling apparatus cooling an object at a low-temperature in a low-temperature container comprising a pulse tube refrigerator including a cold reservoir, a condenser, and a pulse tube; and a liquid reservoir fixed to a vacuum tank through heat-insulating support members.

BACKGROUND ART

A convention cooling apparatus (Japanese Patent Application Laid-Open (kokai) No. 2000-161803) is constructed as shown in FIG. 9. A superconductive magnet 101 cooled by means of a first refrigerant 103*a* such as liquid helium is accommodated within a vessel 102. The vessel 102 is fixed to a vacuum tank 107 via a large number of heat insulating support members 104, a shield plate 105, and a large number of heat insulating support members 106. Vapor of the first refrigerant 103*a* such as liquid helium is condensed to liquid by means of a first cooling unit 110.

A second cooling unit 250 includes a refrigerant circulation circuit 250A and a pulse tube refrigerator 250B. The refrigerant circulation circuit 250A consists of a liquid reservoir 251 fixed to the vacuum chamber 107 through a large number of heat insulating support members 254 and storing a second refrigerant liquid 253*a*1 such as liquid nitrogen; and a conduit 252 receiving the second refrigerant liquid 253*a*1 within the liquid reservoir 251, being in thermal contact with the shield plate 105, and returning to a second refrigerant gas phase portion 253*b* of the liquid reservoir 251.

The pulse tube refrigerator 250B consists of a compressor 250B1 and a second low-temperature generating section 250B2. High-pressure piping 264 of the second low-temperature generating section 250B2 communicates with high-pressure ports of rotary changeover valves 253*a* and 253*b* connected to a drive section 274. Low-pressure piping 263 of the second low-temperature generating section 250B2 communicates with low-pressure ports of the rotary changeover valves 253*a* and 253*b*.

Communication ports of the rotary changeover valves 253*a* and 253*b* communicate with a cold reservoir 255 and an atmospheric-temperature-side throttle 260, respectively. A condenser 256*a* is provided on a low-temperature side of the cold reservoir 255. The condenser 256*a* communicates with a condenser 256*b* provided on a low-temperature side of a pulse tube 258 via a conduit 257. An atmospheric-temperature side of the pulse tube 258 communicates with the throttle 260 via a radiator 259. The high-pressure piping 264 and the low-pressure piping 263 of the second low-temperature generating section 250B are connected to the compressor 250B1 through high-pressure piping 262 and low-pressure piping 261, respectively.

In the above-described cooling apparatus, the pulse tube and the cold reservoir are of substantially the same length. However, when a low temperature to be generated is about 100 K or lower, efficiency lowers unless the length of the pulse tube is at least about three times the length of the cold reservoir. When the length of the pulse tube is set to at least about three times the length of the cold reservoir in order to improve efficiency, a portion of the pulse tube, from the cold end to a point near the midpoint, is immersed in the second refrigerant. As a result, heat is conducted from the pulse tube to refrigerant, accompanied by occurrence of a problem of a lowered rate of condensation of refrigerant vapor.

Moreover, when the cold end of the pulse tube is positioned in the second refrigerant gas phase portion, the pulse tube projects from the vacuum tank by a greater amount as compared with the cold reservoir, accompanied by occurrence of a problem of an increased occupation space of the cooling apparatus.

DISCLOSURE OF THE INVENTION

In view of the foregoing, the present inventor have conceived a technical idea of the present invention such that, in a low-temperature container comprising a pulse tube refrigerator including a cold reservoir, a condenser, and a pulse tube; and a liquid reservoir fixed to a vacuum tank through heat-insulating support members, the condenser is fixed to a cold end of the cold reservoir and is disposed in a gas phase portion of the liquid reservoir; and a cold end of the pulse tube is disposed to be located lower than a hot end of the pulse tube and to be located in a portion corresponding to a liquid phase portion of the liquid reservoir, whereby the amount of projection of the hot end of the pulse tube from the top surface of the vacuum tank is decreased.

Based on the technical concepts of the present invention, the inventors of the present invention have made further extensive studies and developments, thus arriving at completion of the present invention.

An object of the present invention is to reduce the occupation space of the cooling apparatus and to maintain high efficiency of the cooling apparatus.

The present invention (the first invention described in Claim 1) provides a cooling apparatus which comprises a pulse tube refrigerator including a cold reservoir, a condenser, and a pulse tube; and a low-temperature container having a liquid reservoir fixed to a vacuum tank through heat-insulating support members, in which the condenser is fixed to a cold end of the cold reservoir and is disposed in a gas phase portion of the liquid reservoir; and a cold end of the pulse tube is disposed to be located lower than a hot end of the pulse tube and to be located in a portion corresponding to a liquid phase portion of the liquid reservoir.

The present invention (the second invention described in Claim 2) according to the first invention provides a cooling apparatus in which the pulse tube refrigerator comprises a pressure source, a radiator, and a phase adjuster; a high-temperature-side portion of the pulse tube is fixed to the vacuum tank; a low-temperature-side portion of the pulse tube is disposed within the vacuum tank outside the liquid reservoir; and the cold end of the pulse tube and the condenser is connected together through piping.

The present invention (the third invention described in Claim 3) according to the second invention provides a cooling apparatus in which the cold end of the pulse tube is located in a liquid phase portion of the liquid reservoir.

The present invention (the fourth invention described in Claim 4) according to the second invention provides a cooling apparatus in which the cold end of the pulse tube is located within the vacuum tank outside the liquid reservoir.

The present invention (the fifth invention described in Claim 5) according to the third invention or the fourth invention provides a cooling apparatus in which the cold reservoir is disposed to extend vertically in such a manner that the cold reservoir penetrates respective walls of the vacuum tank and the container.

The present invention (the sixth invention described in Claim 6) according to the third invention or the fourth invention provides a cooling apparatus of in which the cold reservoir is disposed to extend horizontally in such a manner that the cold reservoir penetrates respective walls of the vacuum tank and the container.

The present invention (the seventh invention described in Claim 7) according to the fourth invention provides a cooling apparatus in which the cold end of the pulse tube is located within the vacuum tank inside a container which forms the liquid reservoir.

The present invention (the eighth invention described in Claim 8) according to the fourth invention provides a cooling apparatus in which the cold end of the pulse tube is located within the vacuum tank outside a container which forms the liquid reservoir.

The cooling apparatus of the first invention having the above-described construction comprises a low-temperature container which comprises a pulse tube refrigerator including a cold reservoir, a condenser, and a pulse tube; and a liquid reservoir fixed to a vacuum tank through heat-insulating support members, in which the condenser is fixed to a cold end of the cold reservoir and is disposed in a gas phase portion of the liquid reservoir; and a cold end of the pulse tube is disposed to be located lower than a hot end of the pulse tube and to be located in a portion corresponding to a liquid phase portion of the liquid reservoir. Therefore the cooling apparatus of the first invention achieves the effect of reducing the occupation space of the cooling apparatus, because the amount of projection of the hot end of the pulse tube from the top surface of the vacuum tank is decreased.

In the cooling apparatus of the second invention having the above-described construction according to the first invention, the pulse tube refrigerator comprises a pressure source, a radiator, and a phase adjuster; a high-temperature-side portion of the pulse tube is fixed to the vacuum tank; a low-temperature-side portion of the pulse tube is disposed within the vacuum tank outside the liquid reservoir; and the cold end of the pulse tube and the condenser is connected together through piping. Therefore the cooling apparatus of the second invention achieves the effect of reducing the occupation space of the cooling apparatus, because the amount of projection of the hot end of the pulse tube from the top surface of the vacuum tank is decreased.

In the cooling apparatus of the third invention having the above-described construction according to the second invention, the cold end of the pulse tube is located in a liquid phase portion of the liquid reservoir. Therefore the cooling apparatus of the third invention achieves the effect that high efficiency of the cooling apparatus is maintained.

In the cooling apparatus of the fourth invention having the above-described construction according to the second invention, the cold end of the pulse tube is located within the vacuum tank outside the liquid reservoir. Therefore the cooling apparatus of the fourth invention achieves the effect that high efficiency of the cooling apparatus is maintained.

In the cooling apparatus of the fifth invention having the above-described construction according to the third invention or the fourth invention, the cold reservoir is disposed to extend vertically in such a manner that the cold reservoir penetrates respective walls of the vacuum tank and the container. Therefore the cooling apparatus of the fifth invention achieves the effect of performing refrigeration at a temperature lower than the temperature of refrigerant liquid within the liquid reservoir, by use of the condenser fixed to the cold end of the cold reservoir.

In the cooling apparatus of the sixth invention having the above-described construction according to the third invention or the fourth invention, the cold reservoir is disposed to extend horizontally in such a manner that the cold reservoir penetrates respective walls of the vacuum tank and the container. Therefore the cooling apparatus of the sixth invention achieves the effect of performing refrigeration at a temperature lower than the temperature of refrigerant liquid within the liquid reservoir, by use of the condenser fixed to the cold end of the cold reservoir.

In the cooling apparatus of the seventh invention having the above-described construction according to the fourth invention, the cold end of the pulse tube is located within the vacuum tank inside a container which forms the liquid reservoir. Therefore the cooling apparatus of the seventh invention achieves the effect of suppressing the occupation space of the cooling apparatus in the transverse direction.

In the cooling apparatus of the eighth invention having the above-described construction according to the fourth invention, the cold end of the pulse tube is located within the vacuum tank outside a container which forms the liquid reservoir. Therefore the cooling apparatus of the eighth invention achieves the effect that the effective space within the vacuum tank is increased.

BEST MODE FOR CARRYING OUT THE INVENTION

Embodiments of the present invention will now be described with reference to the drawings.

FIRST EMBODIMENT

Figure 1:
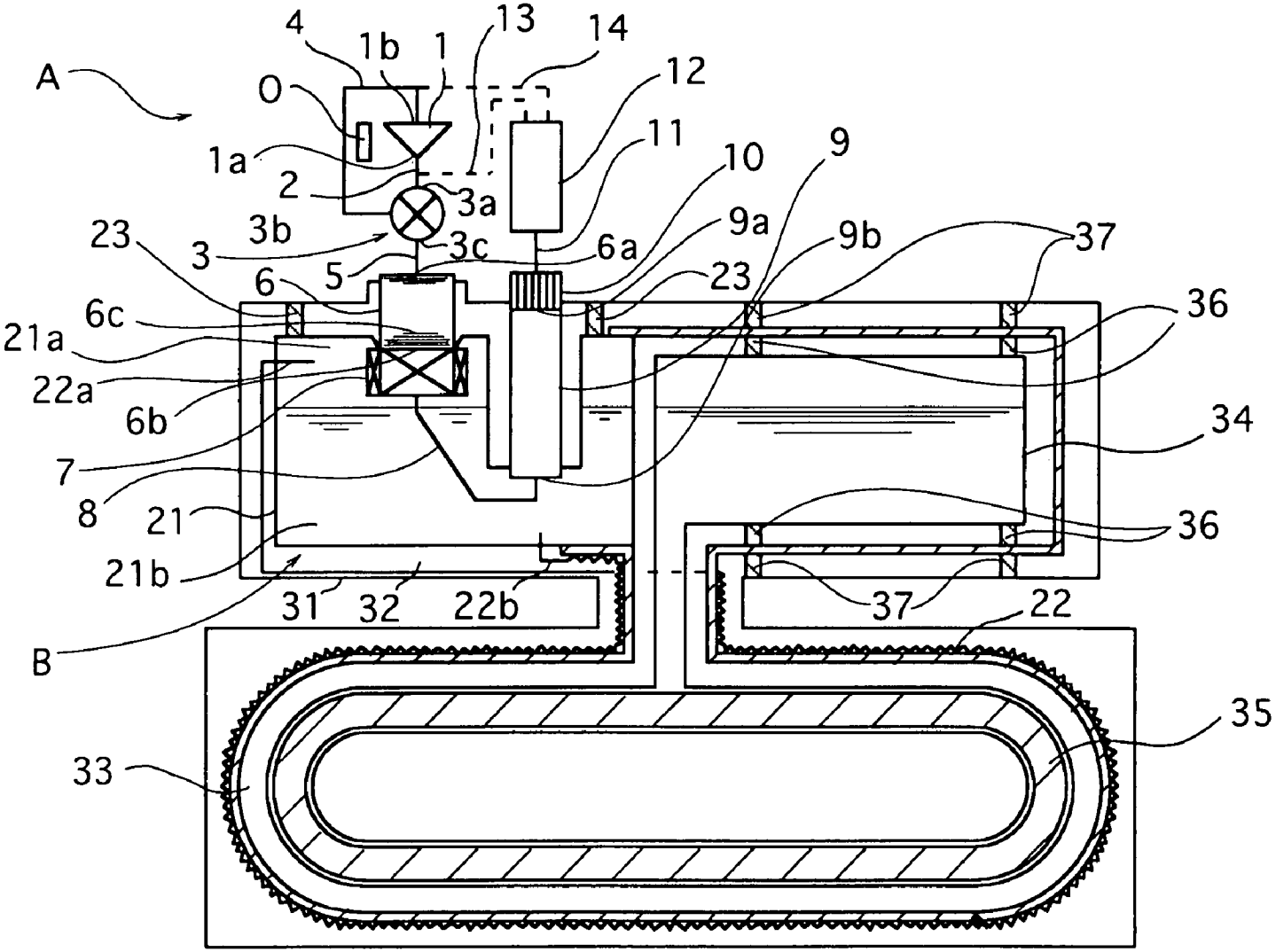
FIG. 1 is a circuit diagram showing the cooling apparatus of the first embodiment according to the present invention.

As shown in FIG. 1, a cooling apparatus according to a first embodiment comprises a pulse tube refrigerator A having a pressure source 1, a cold reservoir 6, a condenser 7, a pulse tube 9, a radiator 10, and a phase adjuster 12; and a low-temperature container having a liquid reservoir 21 fixed to a vacuum tank 31 through heat-insulating support members 36 and 37. The condenser 7 is fixed to a cold end 6*b* of the cold reservoir 6, and is disposed in a gas phase portion 21*a* of the liquid reservoir 21. A hot end of the pulse tube 9 is fixed to the vacuum tank 31 and is disposed in such a manner that a cold end 9*b* of the pulse tube 9 is located lower than the hot end and is located in a liquid phase portion 21*b* of the liquid reservoir 21. The cold end 9*b* of the pulse tube 9 is disposed outside the liquid reservoir 21 but within the vacuum tank 31, and the cold end 9*b* of the pulse tube 9 and the condenser 7 communicate with each other through piping 8.

The cooling apparatus of the first embodiment belongs to the above-described third invention, and is used to cool an object, such as superconductive magnet, by use of, for example, liquid helium.

A discharge port 1*a* of the pressure source 1 is connected to a high-pressure inlet port 3*a* of a changeover valve 3 via a flow passage 2. A suction port 1*b* of the pressure source 1 is connected to a low-pressure outlet port 3*b* of the changeover valve 3 via a flow passage 4.

The changeover valve 3 is configured in such a manner that a port 3*c* of the changeover valve 3 communicates with the high-pressure inlet port 3*a* when refrigerant flows from the pressure source 1 to the cold reservoir 6, and communicates with the low-pressure outlet port 3*b* when refrigerant flows from the cold reservoir 6 to the pressure source 1. The cold reservoir 6 is filled with a cold-reserving material 6*c* such as wire gauze.

The port 3*c* communicates with a hot end 6*a* of the cold reservoir 6 via a flow passage 5. The cold end 6*b* of the cold reservoir 9 communicates with the cold end 9*b* of the pulse tube 9 via the condenser 7 and the flow passage 8. A hot end 9*a* of the pulse tube 9 communicates with the phase adjuster 12 via the radiator 10 and a flow passage 11. Refrigerant compressed at the pressure source 1 is cooled by means of a compressor cooler O. The pulse tube refrigerator A is configured in this manner.

The condenser 7 is disposed in the gas phase portion 21*a* of the liquid reservoir 21, and the cold end 9*b* of the pulse tube 9 is disposed in the liquid phase portion 21*b* of the liquid reservoir 21. The liquid reservoir 21 is fixed to the vacuum tank 31 via a large number of heat-insulating support members 23, and is filed with refrigerant such as liquid nitrogen.

One end 22*b* of a conduit located within a vacuum space 32 of the vacuum tank 31 is connected to a lower end of the liquid phase portion 21*b* of the liquid reservoir 21, and the other end 22*a* of the conduit is connected to the gas phase portion 21*a* of the liquid reservoir 21. The conduit 22 between one end 22*b* and the other end 22*a* thereof is in thermal contact with a shield plate 33 provided within the vacuum space 32. The shield plate 33 covers a vessel 34, which accommodates a superconductive magnet 35.

The vessel 34 is fixed to the vacuum tank 31 via heat insulating support members 36, the shield plate 33, and heat insulating support members 37. The vessel 34 is filled with refrigerant such as liquid helium. The low-temperature container B is configured in this manner. The pulse tube refrigerator A and the low-temperature container B constitute the cooling apparatus.

In the cooling apparatus of the first embodiment having the above-described structure, refrigerant liquid within the liquid reservoir 21 flows into the conduit 22 due to gravity difference, the refrigerant liquid cools the shield plate 33, and becomes vapor, which then flows into the gas phase portion 21*a* of the liquid reservoir 21.

The refrigerant vapor having flowed into the gas phase portion 21*a* is cooled by means of the condenser 7, which effects refrigeration at a temperature lower than the refrigerant liquid within the liquid reservoir 21 of the pulse tube refrigerator A, whereby the refrigerant vapor is liquefied.

Since the cold end 9*b* of the pulse tube 9 is located in the liquid phase portion 21*b* of the liquid reservoir 21, the high efficiency of the pulse tube refrigerator A can be maintained, and a sufficient length of the pulse tube can be secured, without the hot end 9*a* of the pulse tube 9 projecting considerably from the vacuum tank 31.

As a result, heat is not conducted from the pulse tube 9 to the liquid reservoir 21, and the hot end 9*a* of the pulse tube 9 does not project considerably from the vacuum tank 31. Therefore, the occupation space of the cooling apparatus can be reduced.

SECOND EMBODIMENT

Figure 2:
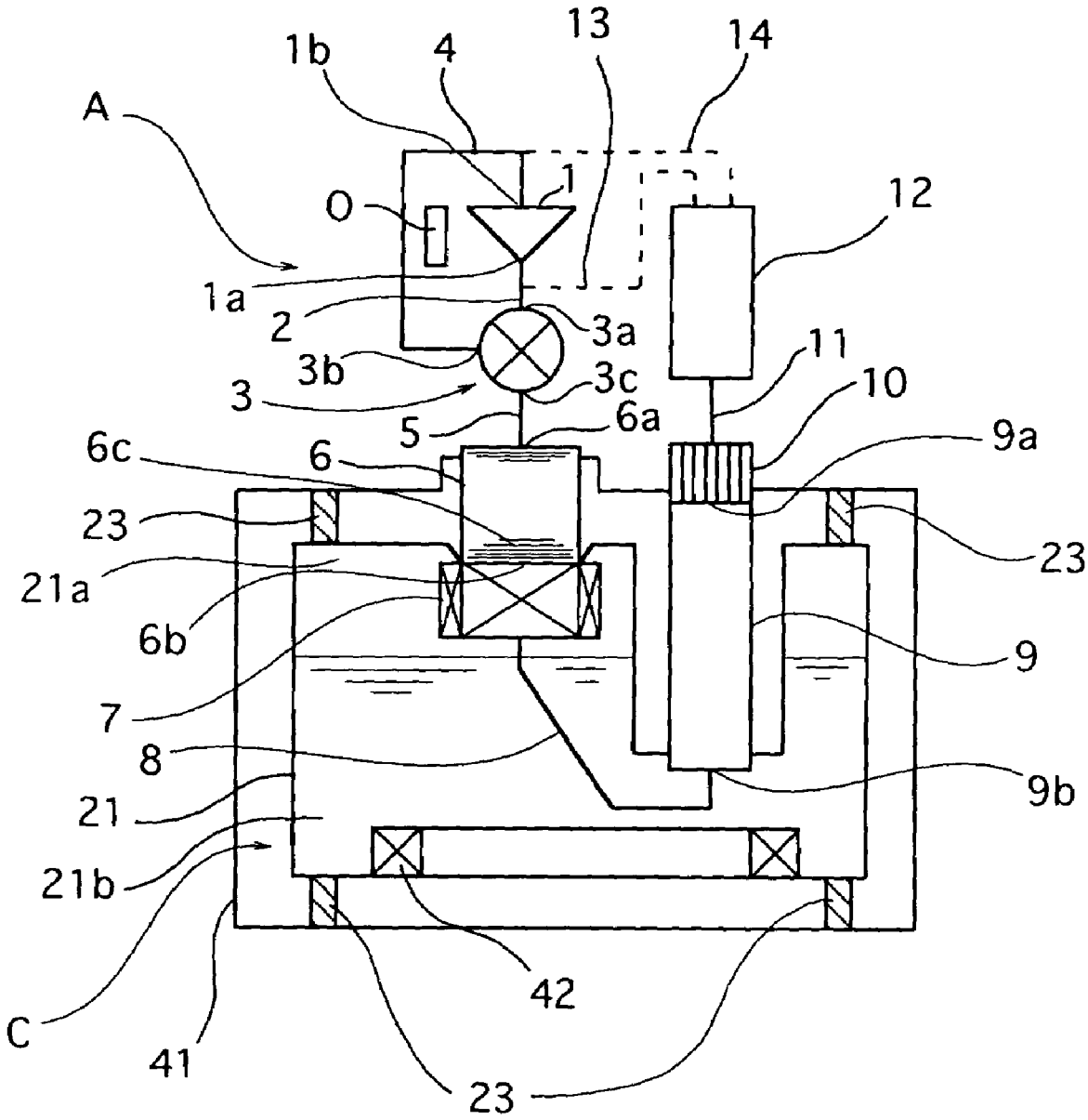
FIG. 2 is a circuit diagram showing the cooling apparatus of the second embodiment according to the present invention.

A cooling apparatus of a second embodiment belongs to the above-described third invention, and is adapted to cool an object, such as high-temperature superconductive magnet, by use of, for example, liquid nitrogen, as shown in FIG. 2.

The pulse tube refrigerator A in the second embodiment is identical with that of the first embodiment shown in FIG. 1. The second embodiment differs from the first embodiment in that an object 42, such as high-temperature superconductive magnet, to be cooled is disposed in the liquid phase portion 21*b* of the liquid reservoir 21, and is cooled by means of refrigerant liquid, such as liquid nitrogen, in the liquid phase portion 21*b* of the liquid reservoir 21.

In other words, a cooling system C is constituted in such a manner that the object 42, such as a high-temperature superconductive magnet, to be cooled is disposed in the liquid phase portion 21*b* of the liquid reservoir 21, which is fixed to the vacuum chamber 41 via the large number of heat-insulating support members 23; and refrigerant liquid, such as liquid nitrogen, is charged into the liquid phase portion 21*b* of the liquid reservoir 21.

The pulse tube refrigerator A and the low-temperature container C constitute the cooling apparatus.

In the cooling apparatus of the second embodiment having the above-described structure, heat from the heat-insulating support members 23 and heat from the object to be cooled 42 are conducted to the liquid phase portion 21*b* of the liquid reservoir 21. Due to this conduction of heat, refrigerant liquid within the liquid phase portion 21*b* moves, in the form of refrigerant vapor, to the liquid phase portion 21*a* of the liquid reservoir 21, where the refrigerant vapor is cooled and liquefied by the condenser 7 of the pulse tube refrigerator A. The thus-produced refrigerant liquid returns to the liquid phase portion 21*b*. Since other operations and effects are the same as those of the first embodiment, their descriptions are omitted.

THIRD EMBODIMENT

Figure 3:
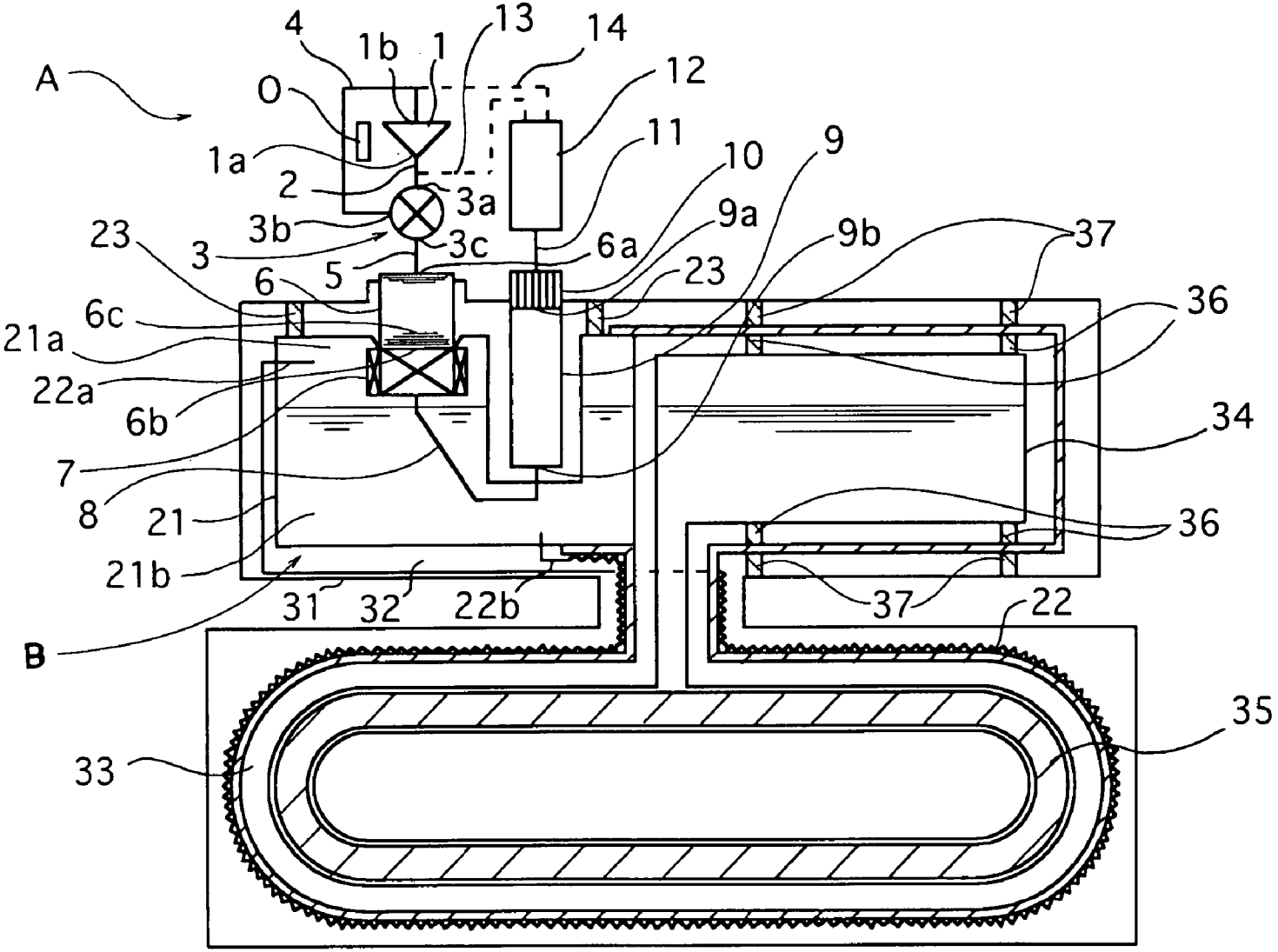
FIG. 3 is a circuit diagram showing the cooling apparatus of the third embodiment according to the present invention.

A cooling apparatus of a third embodiment belongs to the above-described fourth invention, and is adapted to cool an object, such as a superconductive magnet, by use of, for example, liquid helium, as shown in FIG. 3.

The pulse tube refrigerator A in the third embodiment is identical with that of the first embodiment shown in FIG. 1. The third embodiment differs from the first embodiment in that the cold end 9*b* of the pulse tube 9 is not located in the liquid phase portion 21*b* of the liquid reservoir 21, but in the vacuum space 32 outside the liquid reservoir 21.

The cold end 9*b* of the pulse tube 9 communicates with the condenser 7 via the flow passage 8. The flow passage 8 extending from the vacuum space passes through the wall of the liquid reservoir 21 and communicates with the condenser 7 via the liquid phase portion 21*b* and the gas phase portion 21*a*.

The cooling apparatus of the third embodiment having the above-described structure is identical with that of the first embodiment in terms of the operation in which refrigerant vapor within the liquid reservoir 21 becomes liquid and returns to the liquid phase portion 21*b*. Since the cold end 9*b* of the pulse tube 9 is not located in the liquid phase portion 21*b* of the liquid reservoir 21, but in the vacuum space 32 outside the liquid reservoir 21, the high efficiency of the pulse tube refrigerator A can be maintained, and a sufficient length of the pulse tube can be secured, without the hot end 9*a* of the pulse tube 9 projecting considerably from the vacuum tank 31.

As a result, heat is not conducted from the pulse tube 9 to the liquid reservoir 21, and the hot end 9*a* of the pulse tube 9 does not project considerably from the vacuum tank 31. Therefore, the occupation space of the cooling apparatus can be reduced.

FOURTH EMBODIMENT

Figure 4:
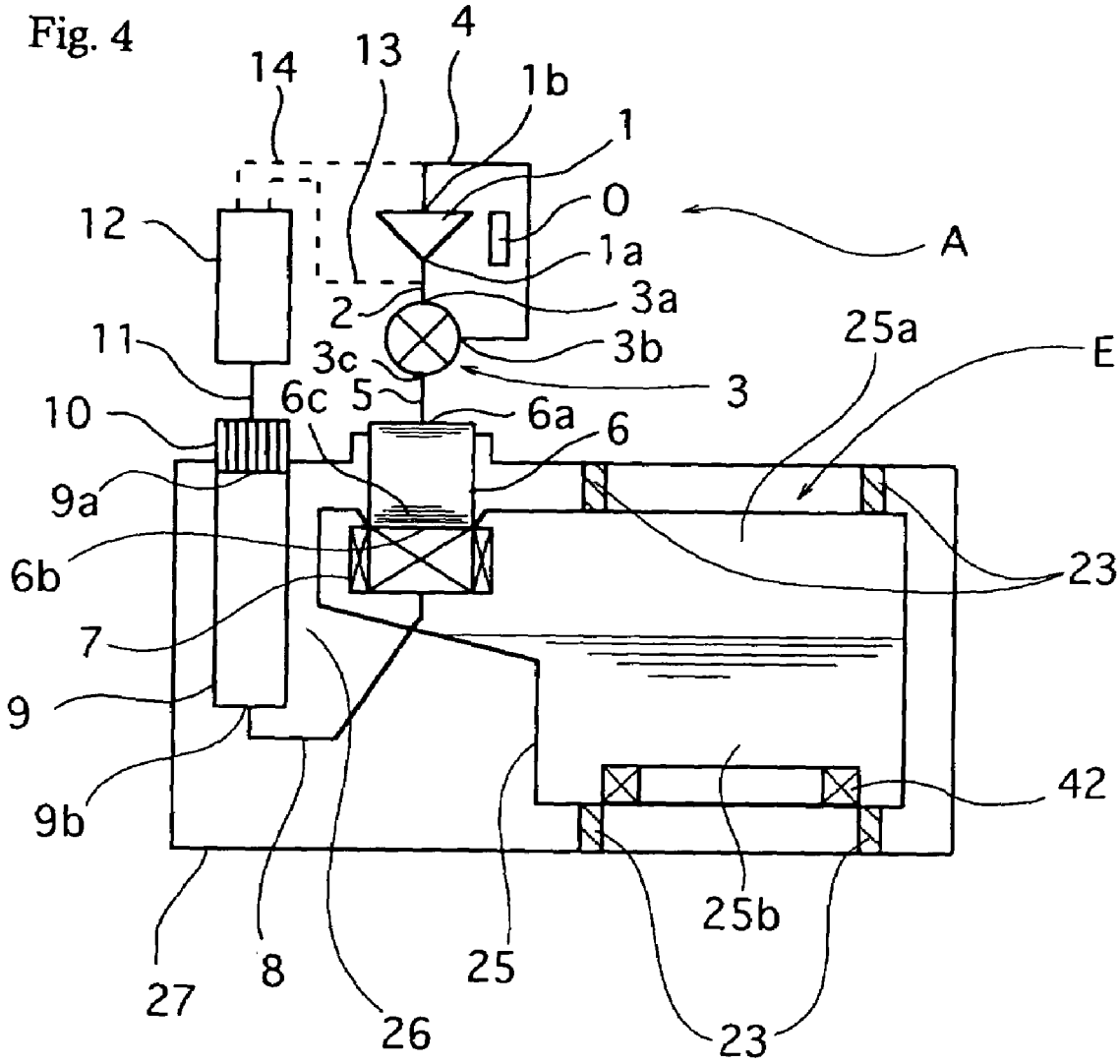
FIG. 4 is a circuit diagram showing the cooling apparatus of the fourth embodiment according to the present invention.

A cooling apparatus of a fourth embodiment belongs to the above-described third embodiment, and is adapted to cool an object, such as a high-temperature superconductive magnet, by use of, for example, liquid nitrogen, as shown in FIG. 4.

The pulse tube refrigerator A in the fourth embodiment is identical with that of the first embodiment shown in FIG. 1. The fourth embodiment differs from the first embodiment in that the cold end 9*b* of the pulse tube 9 is not located in a liquid phase portion 25*b* of a liquid reservoir 25, but in a vacuum space 26 outside the liquid reservoir 25.

The cold end 9*b* of the pulse tube 9 communicates with the condenser 7 via the flow passage B. The flow passage 8 extending from the vacuum space passes through the wall of the liquid reservoir 25 and communicates with the condenser 7. The condenser 7 is disposed within a projecting portion 25*a* formed at a left end upper portion of the liquid reservoir 25. The pulse tube 9 is disposed within the vacuum space 26 to be located on the left side of the projecting portion 25*a* formed at a left end upper portion of the liquid reservoir 25.

The cooling apparatus of the fourth embodiment having the above-described structure is identical with that of the second embodiment as shown in FIG. 2, in terms of the operation in which refrigerant vapor within the liquid reservoir 25 becomes liquid and returns to the liquid phase portion 25*b*. Since the cold end 9*b* of the pulse tube 9 is not located in the liquid phase portion 25*b* of the liquid reservoir 25, but in the vacuum space 26 outside the liquid reservoir 25, the high efficiency of the pulse tube refrigerator A can be maintained, and a sufficient length of the pulse tube can be secured, without the hot end 9*a* of the pulse tube 9 projecting considerably from the vacuum tank 31.

As a result, heat is not conducted from the pulse tube 9 to the liquid reservoir 25, and the hot end 9*a* of the pulse tube 9 does not project considerably from the vacuum tank 27. Therefore, the occupation space of the cooling apparatus can be reduced.

FIFTH EMBODIMENT

Figure 5:
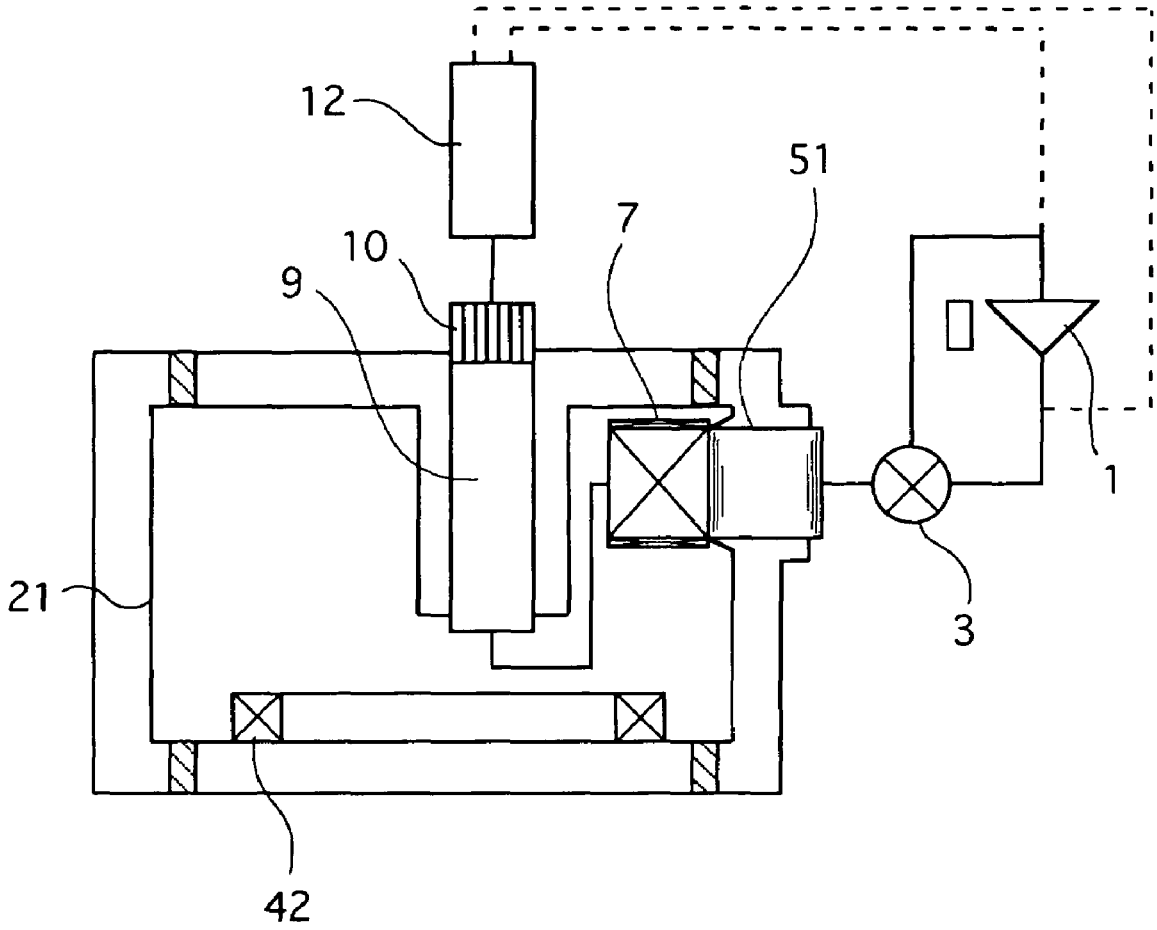
FIG. 5 is a circuit diagram showing the cooling apparatus of the fifth embodiment according to the present invention.

A cooling apparatus of a fifth embodiment belongs to the above-described third and fifth inventions, and is adapted to cool an object, such as a high-temperature superconductive magnet, by use of, for example, liquid nitrogen, as shown in FIG. 5.

The fifth embodiment is a modification of the second embodiment shown in FIG. 2. Specifically, the vertical cold reservoir used in the second embodiment is replaced with a horizontal cold reservoir 51.

The cooling apparatus of the fifth embodiment having the above-described structure achieves an effect such that refrigeration is effected at a temperature lower than the refrigerant liquid within the liquid reservoir 21, by means of the condenser 7, which is attached to a cold end of the cold reservoir 51, which is horizontally disposed to penetrate the respective walls of the vacuum tank and the container.

Since other operations and effects of the cooling apparatus of the fifth embodiment are the same as those of the second embodiment shown in FIG. 2, their description are omitted.

SIXTH EMBODIMENT

Figure 6:
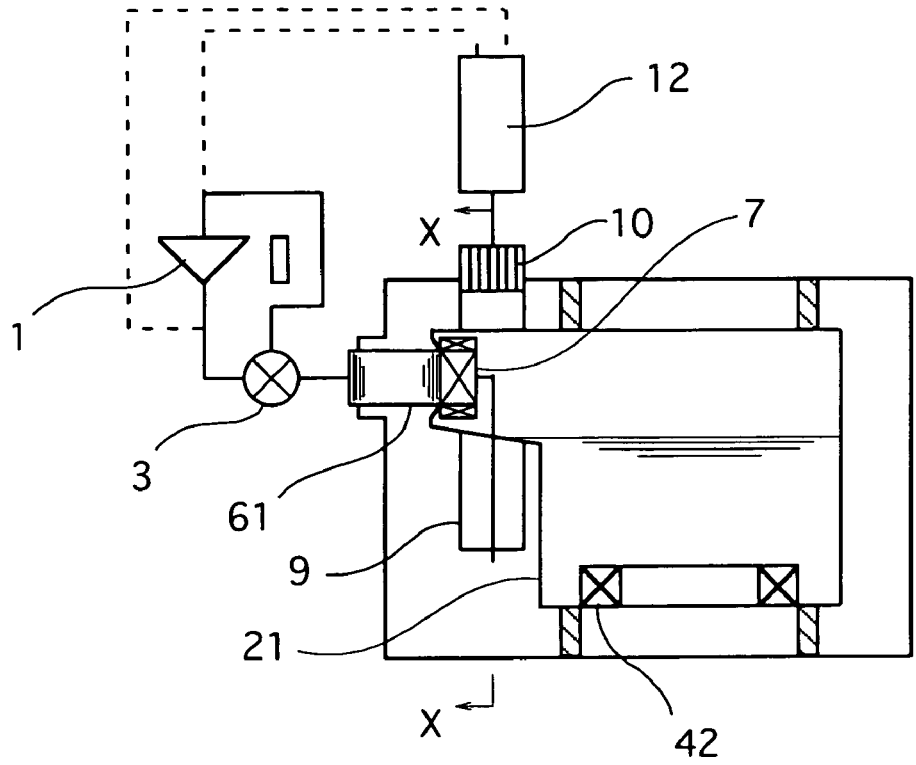
FIG. 6 is a circuit diagram showing the cooling apparatus of the sixth embodiment according to the present invention.
Figure 7:
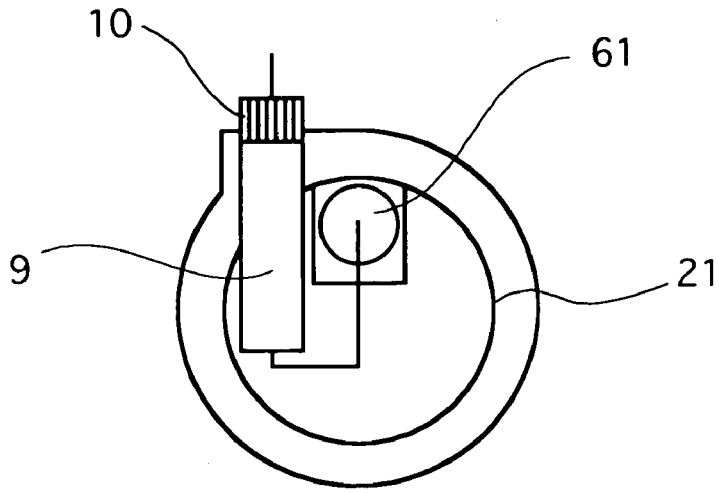
FIG. 7 is a cross section diagram taken along X-X in FIG. 6 showing the cooling apparatus of the sixth embodiment.

A cooling apparatus of a sixth embodiment belongs to the above-described fourth and fifth inventions, and is adapted to cool an object, such as a high-temperature superconductive magnet, by use of, for example, liquid nitrogen, as shown in FIG. 6 and FIG. 7, which shows a cross section taken along X-X in FIG. 6.

The sixth embodiment is a modification of the fourth embodiment shown in FIG. 4. Specifically, the vertical cold reservoir used in the second embodiment is replaced with a horizontal cold reservoir 61.

The cooling apparatus of the sixth embodiment having the above-described structure achieves an effect such that refrigeration is effected at a temperature lower than the refrigerant liquid within the liquid reservoir 21, by means of the condenser 7, which is attached to a cold end of the cold reservoir 61, which is horizontally disposed to penetrate the respective walls of the vacuum tank and the container.

Since other constructions, operations and effects of the cooling apparatus of the sixth embodiment are the same as those of the second embodiment shown in FIG. 2, their description are omitted.

The above-described embodiments of the present invention, as herein disclosed, are taken as some embodiments for explaining the present invention. It is to be understood that the present invention should not be restricted by these embodiments and additions are possible so far as they are not beyond the technical idea or principle based on description of the scope of the patent claims.

Figure 8:
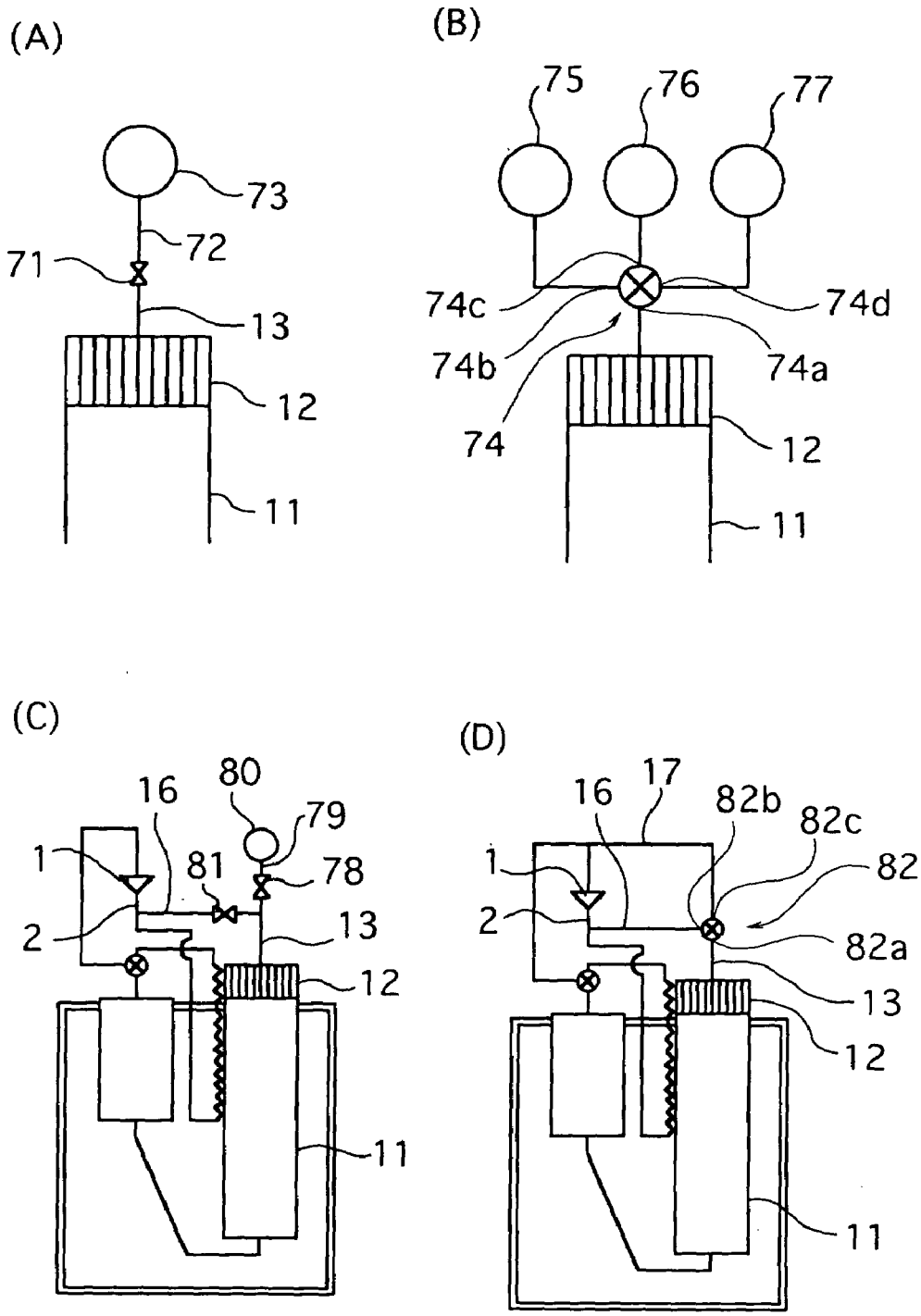
FIG. 8 is a circuit diagram showing four concrete examples of the phase adjuster which may be used in the embodiments of the present invention.
Figure 9:
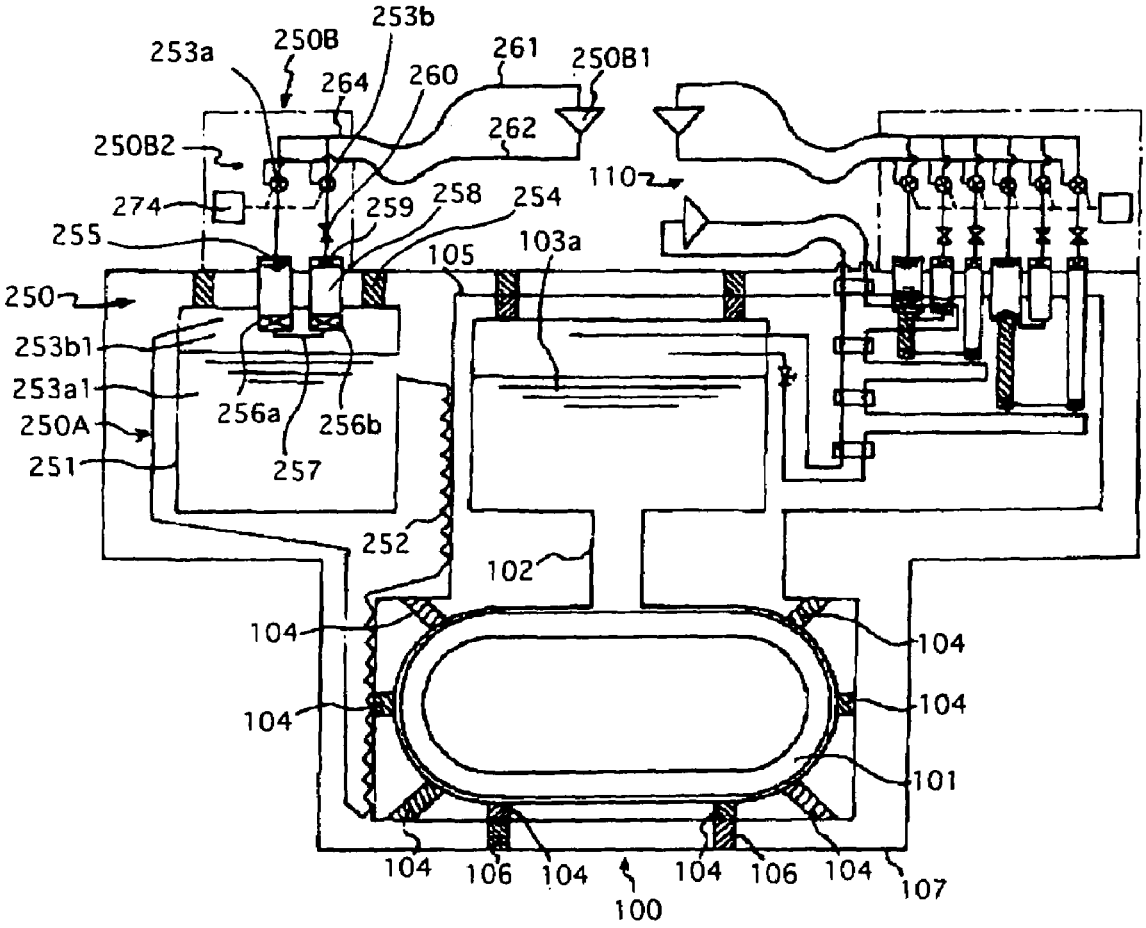
FIG. 9 is a circuit diagram showing a conventional cooling apparatus.

The phase adjuster 12 used in the above-described embodiments may be of an orifice type shown in FIG. 8(A), an active buffer type shown in FIG. 8(B), a double-inlet type shown in FIG. 8(C), a 4-valve type shown in FIG. 8(D), or the like.

In the above-described embodiments, the pulse tube refrigerators are of a single stage type; however, the present invention is not limited thereto, and can be applied to pulse tube refrigerators having two or more stages.

INDUSTRIAL APPLICABILITY

In a low-temperature container used in a cooling apparatus for cooling an object such as a superconductive magnet, the low-temperature container comprising a pulse tube refrigerator including a cold reservoir, a condenser, a pulse tube, and a liquid reservoir fixed to a vacuum tank through heat-insulating support members, the amount of projection of a hot end of the pulse tube from the top surface of the vacuum tank is decreased, whereby the occupation space of the cooling apparatus is reduced, high efficiency of the cooling apparatus is maintained, and the effective space within the vacuum tank is increased.

The invention claimed is:

1. A cooling apparatus comprising a pulse tube refrigerator including a cold reservoir, a condenser, and a pulse tube; and a low-temperature container having a liquid reservoir fixed to a vacuum tank through heat-insulating support members, wherein said condenser is fixed to a cold end of said cold reservoir and is disposed in a gas phase portion of said liquid reservoir; and a cold end of said pulse tube is disposed to be located lower than a hot end of said pulse tube and to be located in a portion corresponding to a liquid phase portion of said liquid reservoir.

2. A cooling apparatus according to claim 1, wherein said pulse tube refrigerator comprises a pressure source, a radiator, and a phase adjuster;

a high-temperature-side portion of said pulse tube is fixed to said vacuum tank;

a low-temperature-side portion of said pulse tube is disposed within said vacuum tank outside said liquid reservoir; and said cold end of said pulse tube and said condenser is connected together through piping.

3. A cooling apparatus according to claim 2, wherein said cold end of said pulse tube is located in a liquid phase portion of said liquid reservoir.

4. A cooling apparatus according to claim 2, wherein said cold end of said pulse tube is located within said vacuum tank outside said liquid reservoir.

5. A cooling apparatus according to claim 3 or 4, wherein said cold reservoir is disposed to extend vertically in such a manner that said cold reservoir penetrates respective walls of said vacuum tank and said container.

6. A cooling apparatus according to claim 3 or 4, wherein said cold reservoir is disposed to extend horizontally in such a manner that said cold reservoir penetrates respective walls of said vacuum tank and said container.

7. A cooling apparatus according to claim 4, wherein said cold end of said pulse tube is located within said vacuum tank inside a container which forms said liquid reservoir.

8. A cooling apparatus according to claim 4, wherein said cold end of said pulse tube is located within said vacuum tank outside a container which forms said liquid reservoir.

* * * * *

UNITED STATES PATENT AND TRADEMARK OFFICE

CERTIFICATE OF CORRECTION

PATENT NO. : 7,272,937 B2
APPLICATION NO. : 10/486353
DATED : September 25, 2007
INVENTOR(S) : Mita et al.

It is certified that error appears in the above-identified patent and that said Letters Patent is hereby corrected as shown below:

On the title page, Item (75), the inventor information is incorrect. Item (75) should read:

-- (75) Inventors: Hideo Mita, Okazaki (JP); Tetuya Gotou, Nagoya (JP); Motohiro Igarashi, Nagoya (JP); Takayuki Furusawa, Nagoya (JP); Toshiyuki Amano, Tokyo (JP); Yoshihiro Jizo, Tokyo (JP) --

Signed and Sealed this

Eighth Day of January, 2008

JON W. DUDAS
*Director of the United States Patent and Trademark Office*